US005835610A

United States Patent [19]

Ishige et al.

[11] Patent Number: 5,835,610

[45] Date of Patent: Nov. 10, 1998

[54] HEARING AIR SYSTEM

[75] Inventors: Ryuuichi Ishige; Reishi Kondo; Yukio Mitome, all of Tokyo, Japan

[73] Assignee: NEC Corporation, Tokyo, Japan

[21] Appl. No.: 774,069

[22] Filed: Dec. 23, 1996

[30] Foreign Application Priority Data

Dec. 22, 1995 [JP] Japan ..... 7-334525

[51] Int. Cl.[6] ..... H04R 25/00

[52] U.S. Cl. ..... 381/315; 381/79

[58] Field of Search ..... 381/68, 68.2, 68.4, 381/79, 110; 455/41, 66

[56] References Cited

U.S. PATENT DOCUMENTS 4,453,264 6/1984 Hochstein ..... 381/110

4,845,755 7/1989 Busch et al. ..... 381/68

5,343,532 8/1994 Shugart, III ..... 381/68

FOREIGN PATENT DOCUMENTS 60-47599 3/1995 Japan .

*Primary Examiner*—Vivian Chang

*Attorney, Agent, or Firm*—Foley & Lardner

[57] ABSTRACT

An external device to be used along with a hearing aid device comprises an input means through which voice data are inputted, a hearing aid processor coupled to the input means for receiving the voice data from the input means to make an acoustic sense compensation of the voice data, and a transmitter coupled to the hearing aid processor for receiving compensated voice data from the hearing aid processor and transmitting the compensated voice data to the hearing aid device.

8 Claims, 2 Drawing Sheets

HEARING AIR SYSTEM

BACKGROUND OF THE INVENTION

The present invention relates to a hearing aid system comprising a hearing aid device as a signal receiver and an external device as a signal transmitter.

In the conventional hearing aid device, voice signals are transmitted via a magnetic loop and a magnetic coupling to the hearing aid device for signal processing therein.

In the Japanese laid-open patent publication No. 60-47599, an automatic selective hearing aid device for listening is disclosed wherein a pilot signal with a specific frequency is superimposed over the electromagnetic field so that this pilot signal is detected for listening by an induction coil.

FIG. 1 is a block diagram illustrative of such an automatically selective hearing aid. A microphone 120 is provided for picking out voices and sounds. An induction coil 121 is provided for picking up an electromagnetic field. A band pass filter 122 is connected to the induction coil 121 for allowing a pilot signal only with a specific frequency to pass A gain control amplifier 123 is coupled to the band pass filter 122 for receiving the output from the band pass filter and amplifying the same at a proper gain. A level detection circuit 124 is coupled to the gain control amplifier 123 for receiving the amplified signal from the gain control amplifier 123 and supplying a driving instruction signal "cc" only when the amplified signal is greater than a predetermined level. First and second switching circuits 126 and 127 are provided. The first switching circuit 126 is coupled to the microphone 120 for receiving signals from the microphone 120. The first switching circuit 126 is also coupled to the level detection circuit 124 for receiving the driving instruction signal "cc". The second switching circuit 127 is coupled to the induction coil 121 for receiving the signal from the induction coil 121. The second switching circuit 127 is also coupled to the level detection circuit 124 for receiving the driving instruction signal "cc". A mixer 129 is provided, which is coupled to the first and second switching circuits 126 and 127. An operational amplifier 132 is provided, which is coupled to the mixer 129 for receiving the signal from the mixer 129 and amplifying the signal. An earphone 134 is provided, which is coupled to the operational amplifier 132.

If the first switching circuit 126 receives the driving instruction signal from the level detection circuit 124, then the first switching circuit 126 comes into OFF state. By contrast, if the second switching circuit 127 receives the driving instruction signal from the level detection circuit 124, then the second switching circuit 127 comes into ON state. If the first switching circuit 126 does not receive the driving instruction signal from the level detection circuit 124, then the fist switching circuit 126 comes into ON state. By contrast, if the second switching circuit 127 does not receive the driving instruction signal from the level detection circuit 124, then the second switching circuit 127 comes into OFF state.

In the prior art, the hearing aid device is designed to perform all of the hearing aid operations. The hearing aid device is required to be driven with a battery power for user's convenience. Minimization and lightening of the hearing aid device are required, in the light of which a large battery is not welcome.

Particularly, as the digital processing is made by use of power consuming elements such as DSP and CPU, this results in a short operational time of the battery.

In the light of the problem with a large power consumption for processing digital signals, it is difficult that complicated digital signal processing is made in the digital hearing aid device that is required to be minimized.

In the above circumstances, it was required to provide a hearing aid system enabling a substantial reduction in power consumption and being free from any complicated signal processing.

SUMMARY OF THE INVENTION

Accordingly, it is an object of the present invention to provide an improved hearing aid system free from the problems described above.

It is a further object of the present invention to provide an improved hearing aid system that enables a substantial reduction in power consumption.

It is a further more object of the present invention to provide an improved hearing aid system that is free from any complicated signal processing.

The above and other objects, features and advantages of the present invention will be apparent from the following descriptions.

The present invention provides a device to be used along with a receiver such as a hearing aid device. The device comprises an input element for inputting voice data, a hearing aid processor coupled to the input element for receiving the voice data from the input element to make an acoustic sense compensation of the voice data, and a transmission element coupled to the hearing aid processor for transmitting the compensated voice data to the receiver such as a hearing aid device.

The present invention also provides a hearing aid device that comprises a microphone for picking up voices and generating voice signals on the basis of the voices picked up, a signal processor coupled to the microphone for fetching the voice signals from the microphone to make an acoustic sense compensation of the fetched voice signals, an amplifier coupled to the signal processor for receiving the compensated voice signals to amplify the voice signals, and an earphone coupled to the amplifier, wherein the hearing aid device is adopted to be used along with an external device that makes an acoustic sense compensation of voice data inputted. The hearing aid device further comprises a receiver circuit for receiving acoustic-sense compensated voice signals having been transmitted from the external device, a switching element coupled to both the receiver circuit and the signal processor for switching from a first connection with the signal processor into a second connection, with the receiver circuit, when the voice signals are received by the receiver circuit, so as to receive the voice signals, and a power controller coupled to both the signal processor and the receiver circuit for controlling respective power supplies to the signal processor and the receiver circuit so that if the receiver circuit receives the voice signals from the external device, then the power controller discontinues the power supply to the signal processor while initiating the power supply to the receiver circuit.

The present invention also provides a hearing aid system comprising a hearing aid device and an external device that are used along with each other. The external device comprises an input element for inputting voice data, a hearing aid processor coupled to the input element for receiving the voice data from the input element to make an acoustic sense compensation of the voice data, and a transmission element coupled to the hearing aid processor for transmitting the compensated voice data to the receiver such as a hearing aid device. The hearing aid device comprises a microphone for picking up voices and generating voice signals on the basis of the voices picked up, a signal processor coupled to the microphone for fetching the voice signals from the microphone to make an acoustic sense compensation of the fetched voice signals, an amplifier coupled to the signal processor for receiving the compensated voice signals to amplify the voice signals, and an earphone coupled to the amplifier, wherein the hearing aid device is adopted to be used along with an external device that makes an acoustic sense compensation of voice data inputted. The hearing aid device further comprises a receiver circuit for receiving acoustic-sense compensated voice signals having been transmitted from the external device, a switching element coupled to both the receiver circuit and the signal processor for switching from a first connection with the signal processor into a second connection with the receiver circuit, when the voice signals are received by the receiver circuit, so as to receive the voice signals, and a power controller coupled to both the signal processor and the receiver circuit for controlling respective power supplies to the signal processor and the receiver circuit so that if the receiver circuit receives the voice signals from the external device, then the power controller discontinues the power supply to the signal processor while initiating the power supply to the receiver circuit.

In the external device to be used along with the hearing aid device, the voice data are inputted via the input element into the hearing aid processor for making an acoustic sense compensation of the voice data for subsequent transmission of the compensated voice data via the transmitter to the receiver of the hearing aid device.

In the digital hearing aid device to be used along with the external device, if the digital hearing aid device receives the voice signal transmitted from the external device, then the digital hearing aid device simply serves as a receiver without supplying any power to the signal processor for reduction in power consumption to secure a long operational time.

In place of the hearing aid device, the external device possesses the capability of performing the hearing aid, wherein the external device is installed. The portable digital hearing aid device simply serves as a receiver by discontinuing the signal processing for receiving the compensated voice signal having been transmitted from the external device when the external device does transmit the voice signal to the hearing aid device.

BRIEF DESCRIPTIONS OF THE DRAWINGS

A preferred embodiment according to the present invention will be described in detail with reference to the accompanying drawings.

EMBODIMENT

Figure 1:
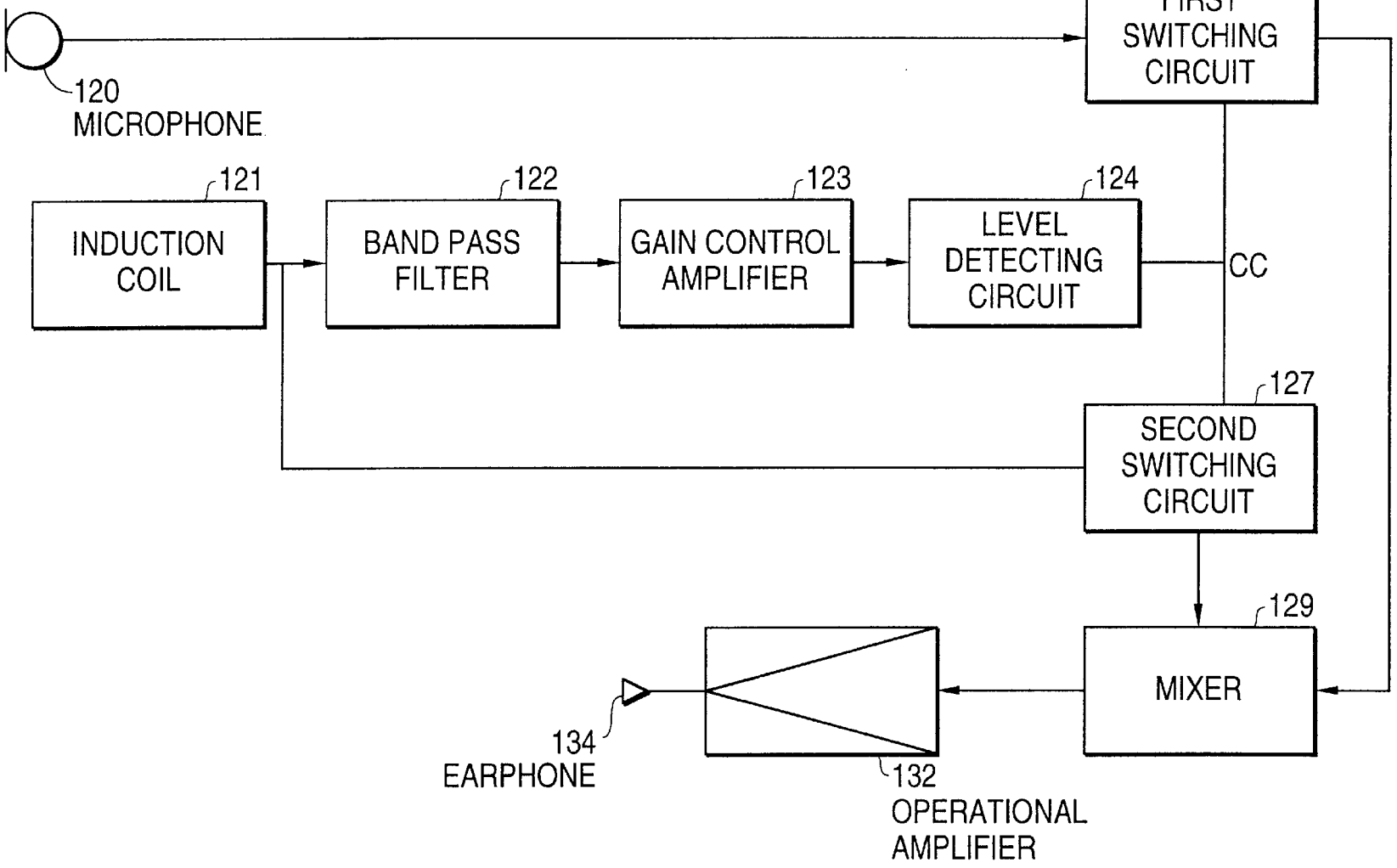
FIG. 1 PRIOR ART
FIG. 1 is a block diagram illustrative of a conventional automatically selective hearing aid device.
Figure 2:
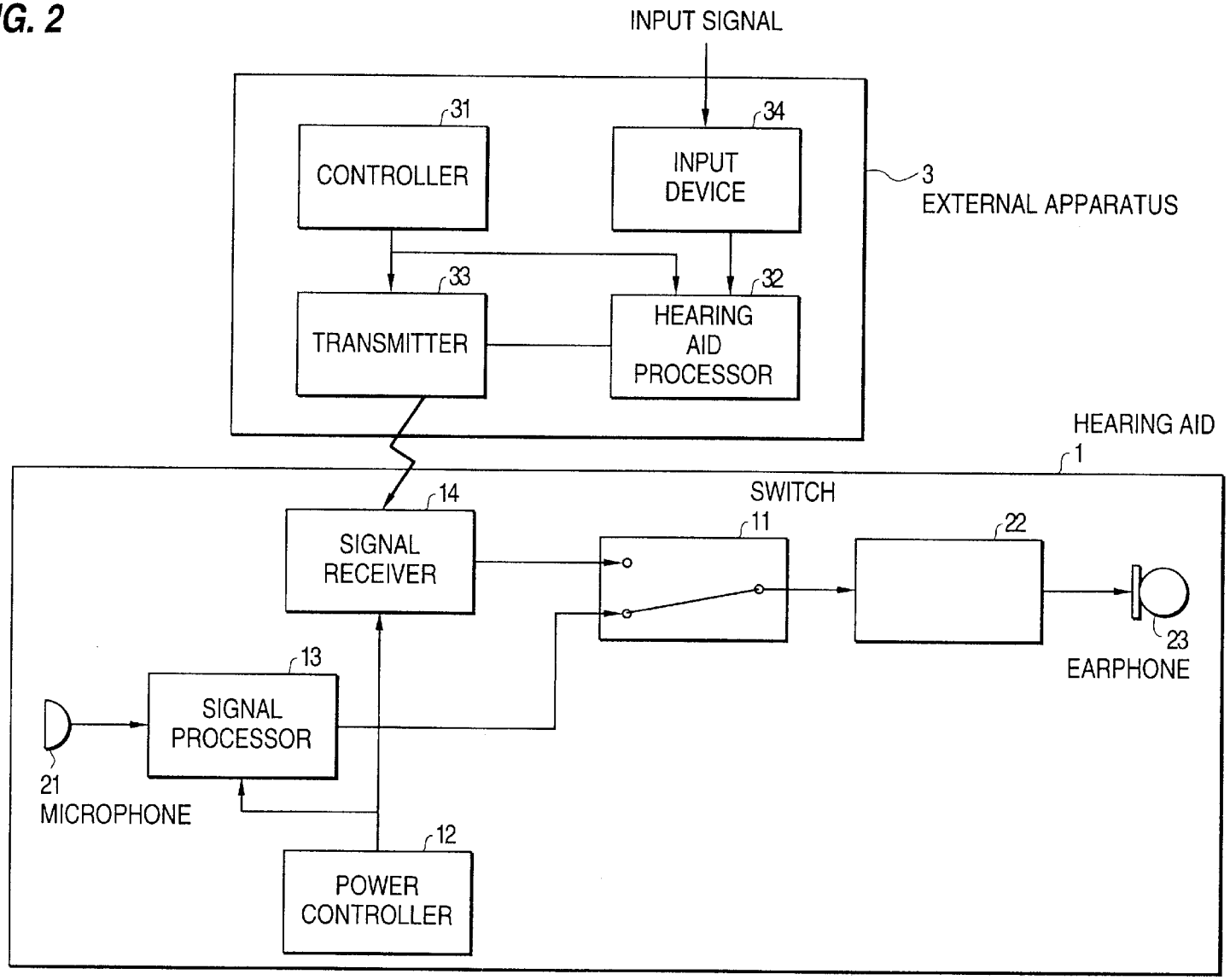
FIG. 2 is a block diagram illustrative of a hearing aid system comprising an installed type external device for substantially performing acoustic sense compensation of voice signal and a portable type digital hearing aid device to be used along with the external device in a preferred embodiment according to the present invention.

A preferred embodiment according to the present invention will be described with reference to FIG. 2, which is illustrative of a hearing aid system comprising an installed type external device 3 for substantially performing acoustic sense compensation of voice signal, and a portable type digital hearing aid device 1 to be used along with the external device 3 in a preferred embodiment according to the present invention.

The external device 3 comprises an input element 34 through which inputting voice data are inputted, a hearing aid processor 32 coupled to the input element 34 for receiving the voice data from the input element 34 to make an acoustic sense compensation of the voice data, a transmitter 33 coupled to the hearing aid processor 32 for transmitting the compensated voice data to a receiver such as a hearing aid device, and a controller 31 coupled to the transmitter 33 and the hearing aid processor 32 for controlling the transmitter 33 and the hearing aid processor 32. Microphones and voice input terminals are available. Via such input element 34, the voice data of television, radio, telephone and the like are inputted. The hearing aid processor 32 has the same capability as the hearing aid of processing input signals having been inputted via the input element 34. The transmitter 33 transmits the processed voice data to the hearing aid device 1 by utilizing radio wave, light, ultrasonic waves, magnetic or infrared ray.

The hearing aid device 1 comprises a microphone 21 for picking up voices and generating voice signals on the basis of the voices picked up, a signal processor 13 coupled to the microphone 21 for receiving the voice signals from the microphone 21 to make an acoustic sense compensation of the receiving voice signals, an amplifier 22 coupled to the signal processor 13 for receiving the compensated voice signals to amplify the voice signals, and an earphone 23 coupled to the amplifier 22. The hearing aid device 1 further comprises a receiver circuit 14 for receiving acoustic-sense compensated voice signals having been transmitted from the external device 3, a switching element 11 coupled to both the receiver circuit 14 and the signal processor 13 for switching from a first connection with the signal processor 13 to a second connection with the receiver circuit 14, when the voice signals are received by the receiver circuit 14, so as to receive the voice signals, and a power controller 12 coupled to both the signal processor 13 and the receiver circuit 14 for controlling respective power supplies to the signal processor 13 and the receiver circuit 14 so that if the receiver circuit 14 receives the voice signals from the external device 3, then the power controller 12, discontinues the power supply to the signal processor 13 while initiating the power supply to the receiver circuit 14.

In the external device 3 to be used along with the hearing aid device 1, the voice data are inputted via,the input element 34 into the hearing aid processor 32 for making an acoustic sense compensation of the voice data for subsequent transmission of the compensated voice data via the transmitter 33 to the receiver 14 of the hearing aid device 1.

In the digital hearing aid device 1 to be used along with the external device 3, if the digital hearing aid device 1 receives the voice signal transmitted from the external device 3, then the digital hearing aid device 1 simply serves as a receiver without supplying any power to the signal processor 13 for the purpose of reduction in power consumption.

In place of the hearing aid device 1, the external device 3 possesses the capability of performing the hearing aid, wherein the external device 3 is installed. The portable digital hearing aid device 1 simply serves as a receiver by discontinuing the signal processing for receiving the compensated voice signal having been transmitted from the external device 3 when the external device 3 transmits the voice signal to the hearing aid device 1 for the purpose of reduction in power consumption of the hearing aid device. Further, since the hearing aid processing is carried out in the external device 2, the hearing aid device 1 may have an additional function for processing more complicated data.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims any modifications of the present invention which fall within the spirit and scope of the present invention.

What is claimed is:

1. A hearing aid device to be used along with an external device that performs an acoustic sense compensation of voice data inputted, said hearing aid device comprising:

a microphone for picking up voices and generating voice signals on the basis of the voices picked up;

a signal processor coupled to said microphone for receiving the voice signals from the microphone to make an acoustic sense compensation of the received voice signals;

an amplifier coupled to the signal processor for receiving the compensated voice signals to amplify the voice signals;

an earphone coupled to the amplifier;

a receiver circuit for receiving the acoustic-sense compensated voice signals that have been transmitted from the external device;

a switching element coupled to both the receiver circuit and the signal processor for switching from a first connection with the signal processor to a second connection with the receiver circuit, when the voice signals are received by the receiver circuit, so as to receive the voice signals from the external device; and a power controller coupled to both the signal processor and the receiver circuit for controlling respective power supplies to the signal processor and the receiver circuit so that if the receiver circuit receives the voice signals from the external device, then the power controller discontinues the power supply to the signal processor while at the same time supplying the power supply to the receiver circuit, wherein said hearing aid device provides the compensated voice data, received from said external device, in audible form to a user of the hearing aid device without performing any additional acoustic compensation.

2. The hearing aid device as claimed in claim 1, wherein said hearing aid device is a portable digital hearing aid device.

3. The hearing aid device as claimed in claim 1, further comprising a second amplifier coupled to the switching element, wherein the acoustic-sense compensated voice signals are amplified by the second amplifier before being sent to the ear of the user, without any frequency compensation being performed by the hearing aid device on the acoustic-sense compensated voice signal.

4. A hearing aid system comprising a hearing aid device and an external device that are used along with each other, wherein said external device comprises:

an input port for inputting voice data;

a hearing aid processor coupled to the input port and configured to receive said voice data from said input port to make an acoustic sense compensation of said voice data; and a transmitter coupled to said hearing aid processor and configured to transmit said compensated voice data to a receiver such as a hearing aid device, and wherein said hearing aid device comprises:

a microphone for picking up voices and generating voice signals on the basis of said voices picked up;

a signal processor coupled to said microphone for receiving said voice signals from said microphone to make an acoustic sense compensation of said received voice signals;

an amplifier coupled to said signal processor and configured to receive said compensated voice signals to amplify said voice signals, and an earphone coupled to said amplifier;

a receiver circuit configured to receive acoustic-sense compensated voice signals that have been transmitted from said external device; and a switching element coupled to both said receiver circuit and said signal processor and configured to switch from a first connection with said signal processor to a second connection with said receiver circuit, when said voice signals are received by said receiver circuit, so as to receive said voice signals from said external device, and a power controller coupled to both said signal processor and said receiver circuit and configured to control respective power supplies to said signal processor and said receiver circuit so that if said receiver circuit receives said voice signals from said external device, then said power controller discontinues said power supply to said signal processor while at the same time supplying the power supply to said receiver circuits, wherein said hearing aid device provides the compensated voice data received form said external device, in audible form to a user of the hearing aid device without performing any additional acoustic compensation.

5. The hearing aid system as claimed in claim 4, further comprising a controller coupled to said transmitter and said hearing aid processor, said controller being configured to control operations of said transmitter and said hearing aid processor.

6. The hearing aid system as claimed in claim 4, wherein said external device is an installed type device.

7. The hearing aid system as claimed in claim 4, wherein said external device is provided in an installed type electric apparatus.

8. The hearing aid device as claimed in claim 4, wherein said hearing aid device further comprises a second amplifier coupled to the switching element, wherein the acoustic-sense compensated voice signals are amplified by the second amplifier before being sent to the ear of the user, without any frequency compensation being performed by the hearing aid device on the acoustic-sense compensated voice signals.

* * * * *